US011305919B2

(12) United States Patent
De Rosa

(10) Patent No.: US 11,305,919 B2
(45) Date of Patent: Apr. 19, 2022

(54) PACKAGING DEVICE PROVIDED WITH A MAGNETIC CLOSURE SYSTEM

(71) Applicant: MAITRISE ET INNOVATION, Val-de-Reuil (FR)

(72) Inventor: Alexandre De Rosa, Gravigny (FR)

(73) Assignee: MAITRISE ET INNOVATION, Val-de-Reuil (FR)

( * ) Notice: Subject to any disclaimer, the term of this patent is extended or adjusted under 35 U.S.C. 154(b) by 118 days.

(21) Appl. No.: 16/281,594

(22) Filed: Feb. 21, 2019

(65) Prior Publication Data

US 2019/0263568 A1 Aug. 29, 2019

(30) Foreign Application Priority Data

Feb. 27, 2018 (FR) ..... 1851685

(51) Int. Cl.
*B65D 41/02* (2006.01)
*B05B 11/00* (2006.01)

(52) U.S. Cl.
CPC ..... *B65D 41/023* (2013.01); *B05B 11/0032* (2013.01); *B05B 11/3047* (2013.01); *B05B 11/3049* (2013.01); *B65D 2313/04* (2013.01)

(58) Field of Classification Search
CPC .. B65D 41/023; B65D 41/02; B65D 2313/04; B65D 88/44; B65D 83/40; B65D 41/026; B65D 41/0471; B65D 41/0485; B65D 1/32; B65D 35/44; B65D 45/02; B65D 47/00; B65D 47/04; B65D 47/0857; B65D 55/00; B05B 11/0032; B05B 11/3049
USPC ..... 220/230; 206/818
See application file for complete search history.

(56) References Cited

U.S. PATENT DOCUMENTS 4,130,220 A * 12/1978 McKirnan ..... B65D 50/067 220/284
5,853,093 A * 12/1998 Neiger ..... B65D 41/0471 215/237
6,382,450 B1 * 5/2002 De Rosa ..... B65D 41/02 206/818
6,831,541 B1 * 12/2004 Seidler ..... A45D 33/006 206/818
8,636,167 B2 * 1/2014 Hajichristou ..... B65D 43/0225 220/230

(Continued)

FOREIGN PATENT DOCUMENTS

EP 1095870 A1 5/2001

*Primary Examiner* — Robert Poon
(74) *Attorney, Agent, or Firm* — Notaro, Michalos & Zaccaria P.C.

(57) ABSTRACT

A packaging device has a principle body with a receptacle having interior space and a neck and orifice, and an expulsion device fixed to the neck, the expulsion device having an upper portion and a lower portion of the expulsion device, the upper and lower portions being separated from one another by a shoulder, the shoulder bearing on the end of the neck, a cap designed to be positioned above the receptacle in a stable closed position, the cap having a housing for receiving an end of the upper portion, and a magnetic closure system having a first magnetic device borne by the cap and a second magnetic device borne by the principle body, the second magnetic device is located around the upper portion and above the shoulder, and, in the stable closed position, the first magnetic device is located around the upper portion and above the second magnetic device.

11 Claims, 4 Drawing Sheets

(56) References Cited

U.S. PATENT DOCUMENTS

| | | | | |
|---|---|---|---|---|
| 9,233,383 | B2 * | 1/2016 | De Rosa | B05B 11/0032 |
| 2006/0111680 | A1 * | 5/2006 | Spada | B65D 47/18 604/295 |
| 2011/0217212 | A1 * | 9/2011 | Solomon | A61M 39/165 422/292 |
| 2013/0341329 | A1 * | 12/2013 | Adler | G09F 3/10 220/288 |
| 2016/0030286 | A1 * | 2/2016 | Fazi | B65D 53/02 220/230 |
| 2018/0257826 | A1 * | 9/2018 | Jung | B05B 11/306 |
| 2019/0000209 | A1 * | 1/2019 | Son | A45D 34/00 |

* cited by examiner

PACKAGING DEVICE PROVIDED WITH A MAGNETIC CLOSURE SYSTEM

TECHNICAL FIELD

The invention relates to the field of magnetic closures for a packaging device used to house a fluid, liquid or pasty product, for example a perfume bottle.

TECHNOLOGICAL BACKGROUND

It is known from the prior art to use a packaging device comprising a magnetic closure system. Generally, such a device comprises a receptacle designed to contain the product and a cap designed to be positioned above the receptacle in order to retain the product in the receptacle and/or to protect the product from the exterior environment and/or to prevent actuation of the mechanism for ejecting the product.

Patent EP1095870 discloses a packaging device for a product comprising a receptacle designed to contain the product, the receptacle comprising a neck provided with a dispensing head, a cap designed to top the dispensing head and a magnetic closure system comprising a first magnetic means borne by the cap and a second magnetic means borne by the receptacle. The receptacle comprises a piece, generally known as being a pump cover with a shoulder, surrounding the neck, the shoulder of the pump cover being located in contact with the receptacle and having an annular housing suitable for containing the second magnetic means. The cap also comprises an annular housing suitable for containing, at the base thereof, the aforesaid first magnetic means in such a manner that, upon closure, the first magnetic means circumscribes the dispensing head and is superposed on the second magnetic means.

Such a prior art device nevertheless involves drawbacks. Indeed, in order to house the second magnetic means on the receptacle, it is necessary to position the shoulder of the pump cover around the neck, which constitutes an unattractive and/or bulky addition on the top of the receptacle. Indeed, although the function of the pump cover is to cover the pump in order to conceal it, the shoulder of the pump cover has no other function than to house the second magnetic means around the neck. Furthermore, in order for the magnetic closure system to be in its closed position, it is necessary for the cap where the first magnetic means is positioned to have a height that enables it to be in contact with the shoulder of the pump cover and also a thickness that is sufficient to house, in the base thereof, the first magnetic means. The cap is thus voluminous and the form of the cap is extremely limited.

SUMMARY

One idea underpinning the invention with a view to eliminating prior art drawbacks is to propose a device, the design of which makes it possible to provide a magnetic closure in the extension of the neck that offers a broader choice of cap form whilst still offering the possibility of reducing the size of the cap in such a manner as to render the device easier to produce, less costly and/or more attractive.

A further idea underpinning the invention is to no longer use a pump cover with a shoulder around the neck in order to house the magnetic means.

A further idea underpinning the invention is to allow efficient closure whilst limiting bulk, for example by limiting the height of the cap.

According to one embodiment, the invention provides a packaging device for a product comprising:

- a principle body including a receptacle comprising an interior space designed to contain the product and a neck projecting from an upper wall of the receptacle and having an orifice, and an expulsion device fixed to the neck, said expulsion device comprising an upper portion and a lower portion of the expulsion device, the upper and lower portions being separated from one another by a shoulder, the shoulder bearing on the end of the neck, the lower portion being located inside the orifice of the neck,
- a cap designed to be positioned above the receptacle in a stable closed position, the cap having a housing for receiving an end of the upper portion of the expulsion device, and
- a magnetic closure system comprising a first magnetic means borne by the cap and a second magnetic means borne by the principle body, such that the first magnetic means and the second magnetic means are positioned by magnetic cohesion relative to one another in the stable closed position of the cap, the cap in the stable closed position being retained on the principle body by the magnetic closure system, wherein the second magnetic means is located around the upper portion of the expulsion device and above the shoulder, and wherein, in the stable closed position, the first magnetic means is located around the upper portion of the expulsion device and above the second magnetic means.

By virtue of these features, the device makes it possible to efficiently close the receptacle with the cap by placing the magnetic closure system just above the shoulder of the dispensing system. This makes it possible to limit the size of the cap and thereby optimize manufacture.

This device makes it possible to dispense with the prior art shoulder of the pump cover with an annular housing where the second magnetic means was housed. This device thus makes it possible to lock the cap relative to the receptacle without the need for this shoulder.

This device also offers the advantage that it is possible to reduce the size of the cap in terms of circumference and thus in terms of thickness or even height. Indeed, it is no longer necessary for it to be designed in order to go as far as entering into contact with the shoulder of the receptacle or a surface of the receptacle. It is thus possible to save on material and to limit the cap in terms of size.

According to other advantageous embodiments, such a device may have one or more of the following features.

According to one embodiment, the second magnetic means is located above the shoulder the of the expulsion device.

According to one embodiment, in the stable closed position, the first magnetic means and the second magnetic means are placed concentrically around the expulsion device.

According to one embodiment, the orifice of the receptacle defines a receptacle axis passing through the centre thereof, the first magnetic means and the second magnetic means being attracted to one another axially relative to the axis of the receptacle in the stable closed position.

According to one embodiment, the cap comprises a peripheral part defining a lateral wall of the housing and an upper part connected to a first end of the peripheral part and defining a back wall of the housing.

According to one embodiment, the expulsion device comprises a pump and the upper portion comprises an actuation plunger, the actuation plunger being configured in order to be located in the housing in the stable closed position.

By virtue of these features, the actuation plunger is surrounded by the cap, which makes it possible to avoid undesired actuation of the expulsion device in the closed position.

According to one embodiment, the actuation plunger is configured in order, in the stable closed position, to be located entirely in the housing.

According to one embodiment, the first magnetic means is located at a second end of the peripheral part of the cap opposite the first end, the second end being configured in order to be located above the second magnetic means in the stable closed position.

According to one embodiment, the cap is manufactured from charged polarized or non-polarized material, and the charged material of the cap thus constitutes the first magnetic means.

According to one embodiment, the cap comprises a peripheral skirt fixed to the second end of the peripheral part, the peripheral skirt being configured in order to surround the neck in the stable closed position.

According to one embodiment, the peripheral skirt is a continuation of the peripheral part and is formed from the same material as the peripheral part in such a manner as to form a continuity of material, for example of plastics, glass, wood, metal, etc. The peripheral skirt faces towards the upper wall of the receptacle. A lower surface of the peripheral skirt may be in contact with the upper wall of the receptacle in a stable closed position. In the stable closed position, the peripheral skirt is located in such a manner as to surround the neck, the expulsion device and, optionally, a pump cover.

By virtue of these features, the peripheral skirt makes it possible for the cap to cover not only the expulsion device upper part but also the neck of the receptacle in such a manner as to protect these elements.

According to one embodiment, the first magnetic means and the second magnetic means are of annular form.

According to one embodiment, the first magnetic means and the second magnetic means are permanently magnetized.

According to embodiments, the first magnetic means and/or the second magnetic means is a monopolar magnet, a bipolar magnet, a quadripolar magnet, a magnet having more than four pairs of poles, a charged polarized material, a charged non-polarized material or a metallic element. However, one of the two magnetic means must be permanently magnetized.

According to one embodiment, the first magnetic means and the second magnetic means are magnets having the same number of poles.

According to one embodiment, the first magnetic means and the second magnetic means are magnets, the number of pairs of poles of which is proportional to the number of faces of the cap and/or the number of faces of the receptacle. For example, in the case of a cap of triangular form, the magnetic means have six pairs of poles (hexapolar magnet) making it possible to have three stable closed positions.

According to one embodiment, the first magnetic means is assembled together with the cap by overmoulding.

Thus, the first magnetic means is fixed to the cap in an efficient and durable manner. Moreover, overmoulding makes it possible to conceal the first magnetic means inside the cap.

According to one embodiment, the first magnetic means is fixed to the cap by adhesive bonding, mechanical assembly or with the aid of an insert.

By virtue of these features, the first magnetic means is securely attached to the cap, thereby preventing detachment thereof. Furthermore, the insert makes it possible to conceal the first magnetic means.

According to one embodiment, the first magnetic means and the second magnetic means are bipolar, the first magnetic means having at least two opposite magnetic poles S1, N1 on its face turned towards the second magnetic means, the facing face of which has complementary magnetic poles N2, S2, the stable closed position then being a single position, namely S1N2/N1S2, thereby making it possible to orient the cap relative to the receptacle as a function of the placing of the poles of the first and second magnetic means.

By virtue of these features, the magnetic closure system formed by the bipolar first magnetic means and the bipolar second magnetic means makes it possible to obtain a single positioning in the stable closed position of the cap relative to the receptacle in such a manner as, for example, to align an exterior embellishment on a face of the receptacle with an exterior embellishment on a face of the cap.

According to one embodiment, the first magnetic means and the second magnetic means are quadripolar, the first magnetic means having at least four magnetic poles S1, N1, S1', N1' on the face of the first magnetic means turned towards the second magnetic means, the facing face of the second magnetic means has four complementary magnetic poles N2, S2, N2', S2', the device then having two stable closed positions, namely a first stable closed position S1N2/N1S2'/S1'N2'/N1'S2 and a second stable closed position S1N2'/N1S2/S1'N2/N1'S2', thereby making it possible to orient the cap in two different ways relative to the receptacle as a function of the placing of the poles of the first and second magnetic means.

Thus, the magnetic closure system formed by the quadripolar first magnetic means and the quadripolar second magnetic means makes it possible to obtain two different, opposite positions in the stable closed position of the cap relative to the receptacle in such a manner as, for example, to align an exterior embellishment of a face of the receptacle with an exterior embellishment of a face of the cap or of an opposite face of the cap.

According to one embodiment, the first magnetic means and the second magnetic means are magnets each comprising 2N pairs of poles, N being a natural whole number greater than or equal to 1, the device then having N stable closed positions, thereby making it possible to orient the cap in N different ways relative to the receptacle as a function of the placing of the poles of the first and second magnetic means.

According to one embodiment, the device comprises a covering, a collar or a pump cover surrounding the neck and/or the expulsion device.

According to one embodiment, the covering, the collar or the pump cover extends from the upper wall of the receptacle to at least the upper portion of the expulsion device, preferably to the actuation plunger, in such a manner as to cover or to conceal the neck of the receptacle and to cover or to conceal the second magnetic means at least partially. The covering, the collar or the pump cover may cover the second magnetic means entirely in such a manner that a part of the covering, of the collar or of the pump cover is located above the second magnetic means and is configured in order, in the stable closed position, to act as gap between the first magnetic means and the second magnetic means.

According to one embodiment, the second magnetic means is located inside the upper portion of the expulsion device, above the shoulder of the expulsion device.

By virtue of these features, the pump cover makes it possible to conceal the neck of the receptacle, with the second magnetic means thereby providing protection for these elements and thus preventing damage thereto or detachment thereof from the principle body.

According to one embodiment, the second magnetic means is a pump cover surrounding the neck and the expulsion device, the pump cover being manufactured from a charged polarized material.

According to one embodiment, in the stable closed position, the peripheral part of the cap bears on an upper part of the pump cover.

According to one embodiment, the pump cover is fixed to the principle body, for example by screwing, crimping or snap-fitting.

Preferably, the lateral wall of the housing has a form making it possible to guide the cap over the upper portion of the expulsion device, for example a cylindrical or other form. According to one embodiment, the cap has a circular cylindrical internal surface fitting slideably, in the stable closed position, on the upper portion which is of circular cylindrical form.

Thus, upon insertion of the cap from an open position to a stable closed position, the cap is free to rotate on the axis of the receptacle, thereby making it possible that the cap can be oriented relative to the receptacle.

According to one embodiment, the expulsion device is fixed to the neck by crimping, screwing or snap-fitting.

BRIEF DESCRIPTION OF THE FIGURES

The invention will be better understood and further objects, details, features and advantages thereof will become more clearly apparent in the course of the following description of a plurality of particular embodiments of the invention, which are given solely by way of illustration and are non-limiting, with reference to the appended drawings.

DETAILED DESCRIPTION OF EMBODIMENTS

By convention, the terms "upper", "lower", "above" and "below" are used to define a relative position of one element or of one part of an element relative to another in a direction seen from the receptacle towards the cap.

Figure 1:
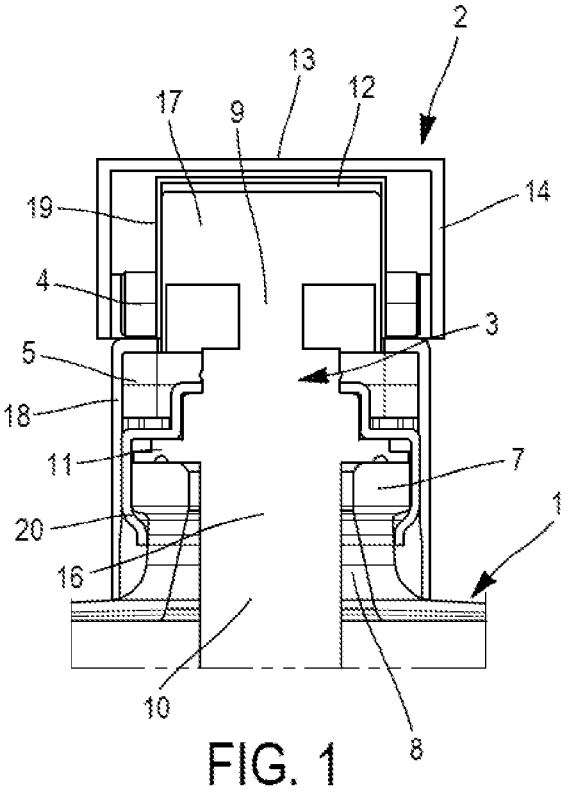
FIG. 1 is a partial view in axial section of a packaging device according to the invention in a first embodiment.
Figure 2:
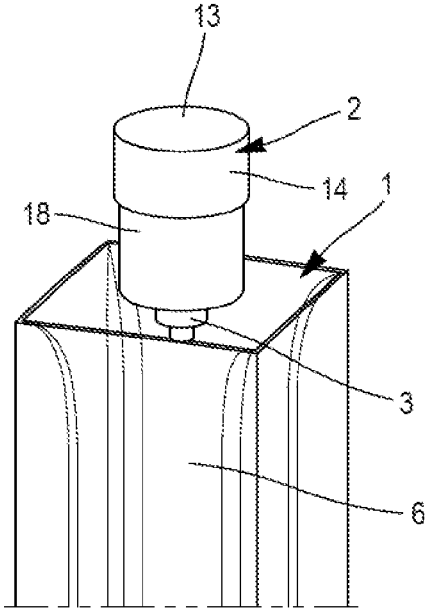
FIG. 2 is a partial view in perspective of a packaging device according to the invention in the first embodiment.

FIGS. 1 and 2 represent a packaging device according to a first embodiment.

The packaging device for a product comprises a principal body including a receptacle 1 and an expulsion device 3 and also comprises a cap 2 and a magnetic closure system 4, 5.

The receptacle 1 is composed of walls surrounding an interior space 6 designed to contain the product and a neck 7 projecting from an upper wall of the receptacle 1. The neck 7 is provided with an orifice 8 that makes it possible for the product to be injected or expelled from the interior space 6 of the receptacle 1.

The expulsion device 3 comprises an upper portion 9 and a lower portion 10, the lower 10 and upper 9 portions being separated from one another by a shoulder 11. The shoulder 11 bears on the end of the neck 7 and is fixed to the neck 7 with the aid of a fixing element 20. The lower portion 10 is located inside the orifice 8 of the neck 7. The lower portion 10 comprises a pump 16 that makes it possible, with the aid of a tube (not shown), to convey the product contained in the receptacle 1 towards the exterior of the receptacle 1. The upper portion 9 comprises an actuation plunger 17 that makes it possible to actuate the pump 16 when the actuation plunger 17 is actuated.

The cap 2 is designed to be positioned above the receptacle 1 in a stable closed position. The cap 2 comprises a housing 12 that makes it possible to receive, in particular, the actuation button 17 of the expulsion device 3. The cap 2 also comprises a peripheral part 14 defining a lateral wall of the housing 12 and an upper part 13 connected to a first end of the peripheral part 14 and defining a back wall of the housing 12.

The magnetic closure system is composed of a first magnetic means 4 and of a second magnetic means 5.

The second magnetic means 5 is borne by the principal body and is located around the upper portion 9 of the expulsion device 3. As presented in FIG. 1, the second magnetic means 5 is of annular form and is positioned just above the shoulder 11 in such a manner as to occupy minimal space. Furthermore, the radial dimension in cross section is approximately equal to the radial dimension in cross section of the shoulder 11, thereby avoiding any superfluous bulk for the second magnetic means 5.

The principal body comprises a pump cover 18 with a radial dimension that is slightly greater than the radial dimension of the neck 7 and of the shoulder 11. The pump cover 18 is designed to surround the neck 7 and the expulsion device 3 and also to cover the second magnetic means 5. A part of the pump cover 18 is thus positioned above the second magnetic means 5. The second magnetic means 5 is therefore held in the space formed between the pump cover 18 and the expulsion device 3, which enables it to be easily fixed, to not be visible to the user and to not be damaged upon use of the packaging device. The pump cover 18 is fixed to the neck 7 of the receptacle 1 or to the expulsion device 3, for example by snap-fitting, crimping or screwing. In the stable closed position of the cap 2 on the receptacle 1, the pump cover acts as gap between the first magnetic means and the second magnetic means, as may be seen in FIG. 1.

In another embodiment, the second magnetic means 5 is located inside the upper portion 9 of the expulsion device 3, above the shoulder 11 of the expulsion device 3. A pump cover 18 is then not necessary for covering and concealing the second magnetic means 5.

In another embodiment, which is not shown, the pump cover 18 and the second magnetic means 5 form one and the same element made from charged polarized or non-polarized material, which makes it possible to optimize manufacture of the device by limiting the number of pieces.

The first magnetic means 4 is borne by the cap 2. The first magnetic means 4 and the second magnetic means 5 are positioned by magnetic cohesion relative to one another in a stable closed position, which makes it possible to place the actuation plunger 17 inside the housing 12 of the cap 2, as may be seen, for example, in FIGS. 1, 3 and 5. The magnetic cohesion is thus exerted in the direction of the axis of the receptacle, and then termed axial magnetic cohesion.

Figure 3:
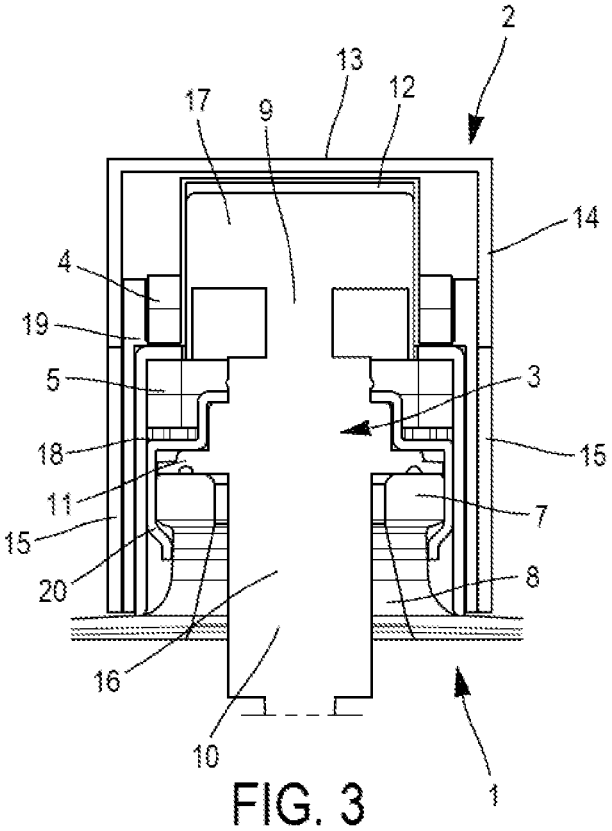
FIG. 3 is a partial view in axial section of a packaging device according to the invention in a second embodiment.

In the first embodiment, illustrated in FIG. 1, or in the second embodiment, illustrated in FIG. 3, the first magnetic means 4 is kept on the cap 2 with the aid of an insert 19. The insert 19 is fixed inside the cap 2 on the back wall of the housing 12 and on the peripheral wall of the housing 12. The insert 19 comprises an insert housing. The first magnetic means 4 is positioned inside the insert housing before the insert is fixed to the cap 2. The first magnetic means 4 is thus fixed to the cap 2 in a robust manner and is, moreover, protected by the insert 19.

The first magnetic means 4 is positioned around the housing 12 of the cap 2 and is located close to a second end of the peripheral part 14 of the cap 2. The first magnetic means 4 has an exterior radial dimension in cross section that is equal or substantially equal to the exterior radial dimension in cross section of the second magnetic means 5. Furthermore, the first magnetic means 4 has an interior radial dimension in cross section equal or substantially equal to the interior radial dimension in cross section of the second magnetic means 5. In the case of a first magnetic means 4 and of a second magnetic means 5 of annular form, the interior radial dimension in cross section and the exterior radial dimension in cross section correspond to the exterior diameter and to the interior diameter, respectively.

It is also possible for the second magnetic means 5 to have an exterior radial dimension in cross section that is greater than the exterior radial dimension in cross section of the first magnetic means 4, but in that case, in order for the magnetic attraction to be optimal, the interior radial dimension in cross section of the second magnetic means 5 must be smaller than or equal to the interior radial dimension in cross section of the first magnetic means 4.

In the stable closed position of the cap 2 on the principal body, the first magnetic means 4 is located around the upper portion 9 of the expulsion device 3 and above the shoulder 11 in such a manner as to be placed concentrically relative to the second magnetic means 5 and just above the second magnetic means 5.

In the first embodiment, which can be seen in FIG. 1, and in the second embodiment, which can be seen in FIG. 2, the gap between the first magnetic means 4 and the second magnetic means 5 is embodied by a part of the pump cover 18 and a part of the insert 19.

FIG. 3 represents a second embodiment of the packaging device. In the second embodiment, only the design of the cap 2 is different as compared with the first embodiment.

Indeed, in the second embodiment, the cap 2 comprises a peripheral skirt 15. A first end of the peripheral skirt 15 is fixed to the second end of the peripheral part 14 in such a manner as to form a continuation of the peripheral part 14. In the stable closed position, the peripheral skirt 15 surrounds the neck 7 and the pump cover 18. A second end of the peripheral skirt 15 is thus located close to the upper wall of the receptacle 1 in the stable closed position, making it possible to completely protect the expulsion device 3 and the pump cover 18.

Figure 4:
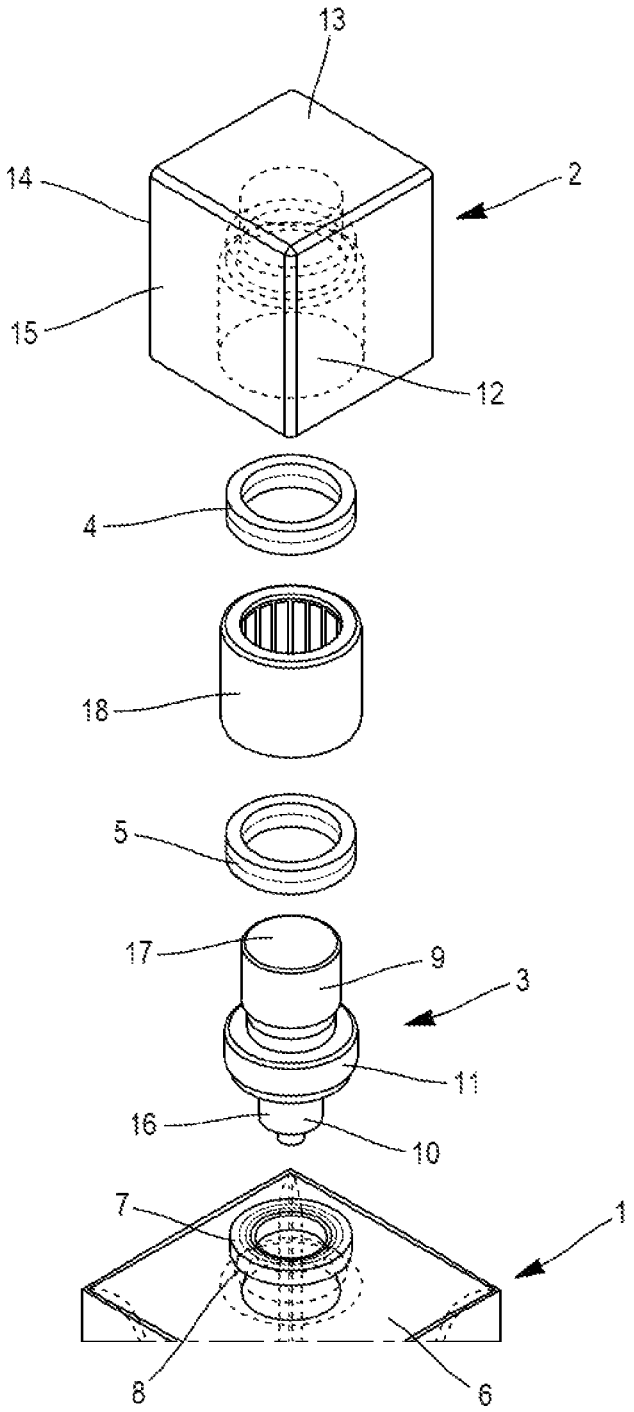
FIG. 4 is a partial expanded view of a packaging device according to the invention in a third embodiment.
Figure 5:
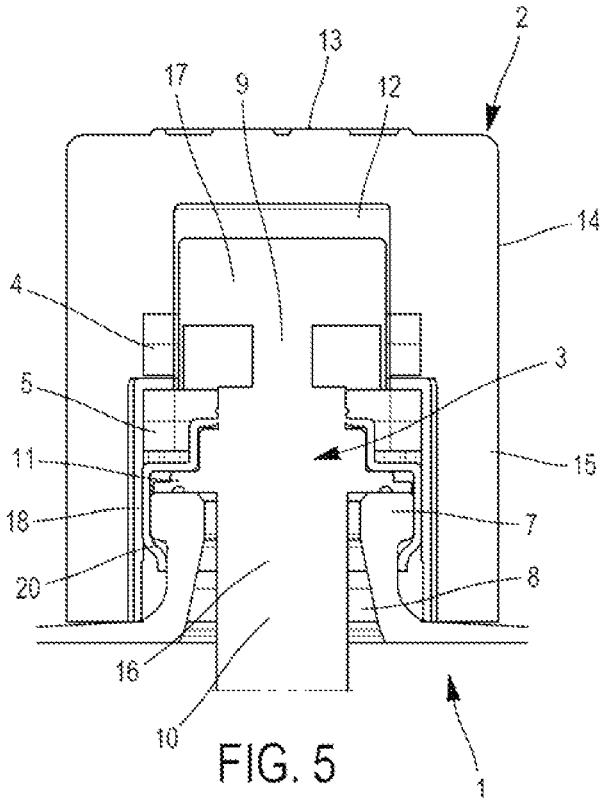
FIG. 5 is a partial view in axial section of a packaging device according to the invention in the third embodiment.

FIGS. 4 and 5 represent a third embodiment of the packaging device. In the third embodiment, only the fixing of the first magnetic means 4 to the cap 2 is different as compared with the second embodiment.

In the third embodiment, the cap 2 has no insert 19 for fixing the first magnetic means 4, as was the case in the first and second embodiment. Indeed, the first magnetic means 4 is, in this case, overmoulded inside the cap 2 in such a manner that the overmoulding makes it possible for the first magnetic means 4 to be fixed to the cap 2 without the use of an exterior element such as the insert 19. The first magnetic means 4 is fixed in the cap at the same location as for the first and second embodiments, namely around the housing 12 of the cap 2 and close to a second end of the peripheral part 14 of the cap 2.

In another embodiment, which is not shown, the cap 2 and the first magnetic means 4 form one and the same element made from charged polarized or non-polarized material, which makes it possible to optimize manufacture of the device by limiting the number of pieces.

In FIGS. 1 to 5, the expulsion device 3 is equipped with a fixing element 20 on the lower portion 10 of the expulsion device 3, making it possible to crimp the expulsion device 3 on the neck 7 of the receptacle 1. When the expulsion device 3 is positioned on the receptacle 1, namely with the lower portion 10 inside the orifice 8 of the neck 7 and the shoulder 11 bearing on the end of the neck 7, the fixing element 20 is deformed in a plastic manner such as to clasp the neck 7, which has the effect of immobilizing the expulsion device in position. The expulsion device 3 is then termed an expulsion device 3 for crimping. This method of fixing by crimping has the advantage of durably fixing the expulsion device 3 on the receptacle 1, but the disadvantage of this is that it cannot be removed. However, there are other fixing methods.

Figure 6:
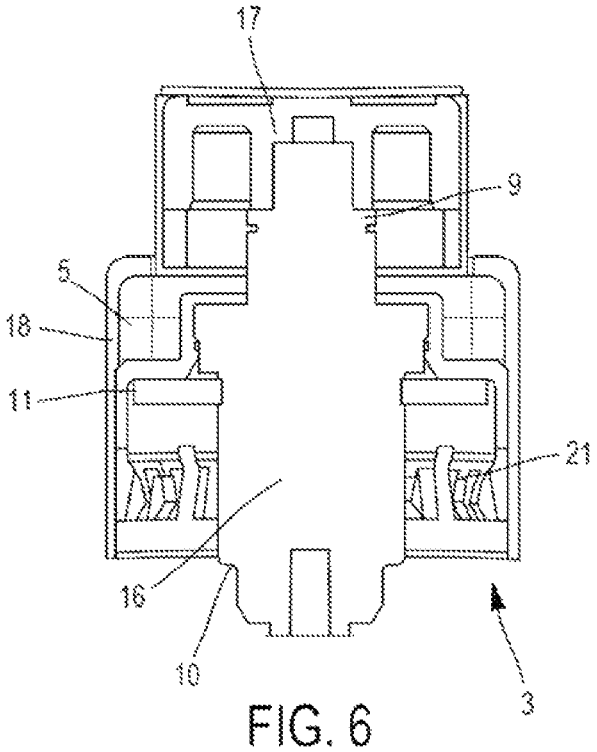
FIG. 6 is a view in axial section of an expulsion device, according to the invention in one embodiment, for snap-fitting.

FIG. 6 represents a "snap-fitting" expulsion device 3. The expulsion device 3 is, in this case, provided with elastically deformable elements 21 on the lower portion 10 of the expulsion device 3, making it possible to snap-fit the expulsion device 3 on the neck 7 of the receptacle 1. In order to be able to position the expulsion device 3 on the receptacle 1, it is necessary for the elastically deformable elements 21 to be deformed in order to be placed around the neck 7. With deformation remaining in the elastic domain of the elements 21, the elements 21 exert a force continuously right around the neck in order to resume their position, which makes it possible to hold the expulsion device 3 in position on the neck 7. This fixing method has the advantage of being easily dismantlable, but has the disadvantage of fixing the expulsion device 3 less durably.

Figure 7:
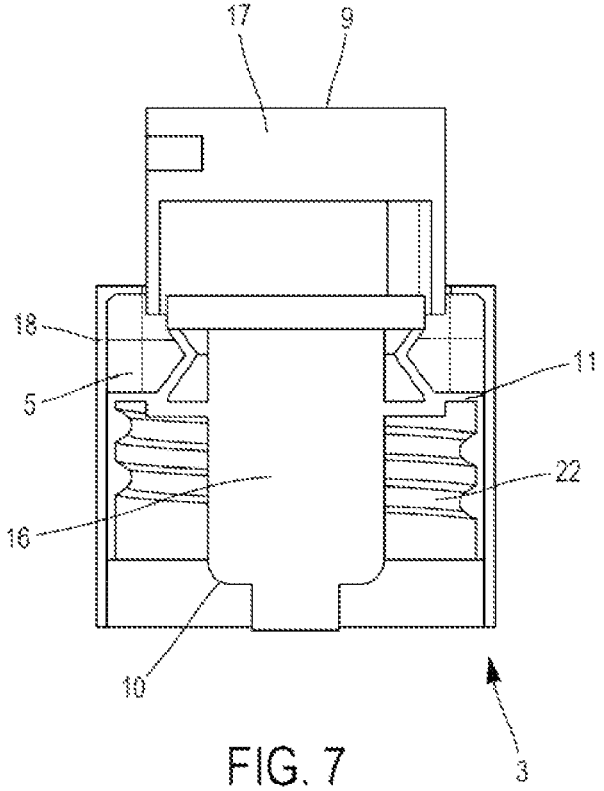
FIG. 7 is a view in axial section of an expulsion device, according to the invention in one embodiment, for screwing.

FIG. 7 represents a "screw-on" expulsion device 3. The expulsion device 3 is, in this case, provided with an inside thread 22 on the lower portion 10 of the expulsion device 3, making it possible to screw the expulsion device 3 onto a complementary thread of the neck 7. In order to be able to position the expulsion device 3 on the receptacle 1, it is necessary to place the inside thread 22 at the level of the thread of the neck 7 and then to effect a screwing action until the shoulder 11 of the expulsion device 3 comes to bear on the end of the neck 7. This fixing method has the advantage of being a good compromise between the durability of fixing and the ease of removal, but has the disadvantage of being more difficult to manufacture with, also, effort on the neck 7 of the receptacle 1.

When equipped with a magnetic closure system comprising at least one bipolar or quadripolar magnet, the packaging device allows the relative positioning of the cap 2 with respect to the receptacle 1. The relative positioning of the cap 2 with respect to the receptacle 1 is, in particular, described in publication EP1095870 A1. Indeed, for example, it is possible to position a face of the cap or an ornamental element of the cap 2 relative to a face of the principal body or of an ornamental element of the principal body by judicious choice of the placement of the poles of the first and second magnetic means in the cap 2 and the principal body.

By way of example, the first magnetic means 4 and the second magnetic means 5 are bipolar annular magnets of the same size.

Of course, the number of poles of the magnets on each magnet may be changed without departing from the scope of the invention. Furthermore, the magnets may be replaced by charged polarized material, for example.

By way of example, the magnets may be made from neodymium-iron-boron.

Although the invention has been described in connection with a plurality of particular embodiments, it is quite obvious that it is in no way limited thereto and that it comprises all technical equivalents of the means described and also combinations thereof if these fall within the scope of the invention.

The use of the verb "comprise" or "include", and conjugated forms thereof, does not exclude the presence of elements or of steps other than those stated in a claim.

In the claims, any reference sign between parentheses should not be interpreted as a limitation of the claim.

The invention claimed is:

1. Device for packaging a product comprising:

a principle body including a receptacle (1) comprising an interior space (6) configured to contain the product and a neck (7) projecting from an upper wall of the receptacle (1) wherein the neck has an orifice (8) which defines a receptacle axis passing through a center of the orifice, and an expulsion device (3) fixed to the neck (7), said expulsion device (3) comprising an upper portion (9) and a lower portion (10) of the expulsion device (3), the upper and lower portions being separated from one another by a shoulder (11), the shoulder (11) bearing on an end of the neck (7), the lower portion (10) being located inside the orifice (8) of the neck (7), a cap (2) configured to be positioned above the receptacle (1) in a stable closed position, the cap (2) having a housing (12) for receiving an end of the upper portion (9) of the expulsion device (3), the cap (2) comprising a peripheral part (14) defining a lateral wall of the housing (12) and an upper part (13) connected to a first end of the peripheral part (14) and defining a back wall of the housing (12), and a magnetic closure system comprising a first magnetic means (4) borne by the cap (2) and a second magnetic means (5) borne by the principle body, such that the first magnetic means (4) and the second magnetic means (5) are positioned by magnetic cohesion relative to one another in the stable closed position of the cap (2), the cap (2) in the stable closed position being retained on the principle body by the magnetic closure system, wherein the second magnetic means (5) is located around the upper portion (9) of the expulsion device (3) and above the shoulder (11), and wherein, in the stable closed position, the first magnetic means (4) is located around the upper portion (9) of the expulsion device (3) and above the shoulder (11), the first magnetic means and the second magnetic means being attracted to one another axially relative to the axis of the receptacle in the stable closed position, the first magnetic means (4) being located at a second end of the peripheral part (14) of the cap (2) opposite the first end, the second end being configured in order to be located above the second magnetic means (5) in the stable closed position.

2. Device according to claim 1, wherein the expulsion device (3) comprises a pump (16) and the upper portion (9) comprises an actuation plunger (17), the actuation plunger (17) being configured in order to be located in the housing (12) in the stable closed position.

3. Device according to claim 1, wherein the cap (2) comprises a peripheral skirt (15) fixed to the second end of the peripheral part (14), the peripheral skirt (15) being configured in order to surround the neck (7) in the stable closed position.

4. Device according to claim 1, wherein the first magnetic means (4) is a monopolar magnet, a bipolar magnet, a quadripolar magnet, a magnet having more than four pairs of poles, a charged polarized material, a charged non-polarized material or a metallic element.

5. Device according to claim 1, wherein the second magnetic means (5) is a monopolar magnet, a bipolar magnet, a quadripolar magnet, a magnet having more than four pairs of poles, a charged polarized material, a charged non-polarized material or a metallic element.

6. Device according to claim 1, wherein the first magnetic means (4) is assembled together with the cap (2) by overmoulding, adhesive bonding or mechanical assembly.

7. Device according to claim 1, wherein the first magnetic means (4) and the second magnetic means (5) are bipolar, the first magnetic means (4) having at least two opposite magnetic poles S1, N1 on its face turned towards the second magnetic means (5), the facing face of which has complementary magnetic poles N2, S2, the stable closed position then being a single position and thereby making it possible to orient the cap (2) relative to the receptacle (1) as a function of the placing of the poles of the first and second magnetic means.

8. Device according to claim 1, wherein the first magnetic means (4) and the second magnetic means (5) are quadripolar, the first magnetic means (4) having at least four magnetic poles S1, N1, S1', N1' on the face of the first magnetic means (4) turned towards the second magnetic means (5), the facing face of the second magnetic means (5) has four complementary magnetic poles N2, S2, N2', S2', the device then having two stable closed positions, thereby making it possible to orient the cap (2) in two different ways relative to the receptacle (1) as a function of the placing of the poles of the first and second magnetic means.

9. Device according to claim 1, wherein the device comprises a pump cover (18) surrounding the neck (7) and the expulsion device (3), the pump cover extending from the upper wall of the receptacle (1) to at least the upper portion (9) of the expulsion device (3) in such a manner as to at least partially cover the second magnetic means (5).

10. Device according to claim 1, wherein the cap (2) has a circular cylindrical internal surface fitting slideably, in the stable closed position, on the upper portion (9) which is of circular cylindrical form.

11. Device according to claim 1, wherein the expulsion device (3) is fixed to the neck (7) by crimping, screwing or snap-fitting.

* * * * *